United States Patent [19]

Barkouki

[11] Patent Number: 4,659,231

[45] Date of Patent: Apr. 21, 1987

[54] ISLAMIC PRAYER CALCULATOR/CLOCK DEVICE

[76] Inventor: Moghazi F. Barkouki, Ushigomedai Mansion #406, 71 Ichigaya-Yakuoji-cho, Shinjuku-ku, Tokyo, Japan

[21] Appl. No.: 580,861

[22] Filed: Feb. 16, 1984

[30] Foreign Application Priority Data

Feb. 19, 1983 [JP] Japan ..... 58-026614
Dec. 23, 1983 [JP] Japan ..... 58-248605

[51] Int. Cl.[4] ..... G04B 19/26
[52] U.S. Cl. ..... 368/15; 368/10
[58] Field of Search ..... 368/15–20, 368/10

[56] References Cited

U.S. PATENT DOCUMENTS 4,253,169 2/1981 Salah ..... 368/15
4,396,293 8/1983 Mizoguchi ..... 368/15

FOREIGN PATENT DOCUMENTS 1597411 9/1981 United Kingdom ..... 368/10

*Primary Examiner*—Bernard Roskoski
*Attorney, Agent, or Firm*—Kenneth R. Glaser

[57] ABSTRACT

Means are provided for inputting to an electronic computing device the latitude and longitude of a spot on the surface of the Earth, and also for inputting a date, and the computing device then calculates the proper Islamic prayer times at said spot on said date, via determining the position of the sun in the heavens, according to said date and said latitude and longitude information. Then an outputting means outputs from said electronic computation means said appropriate times for Islamic prayer on said date at said spot on the surface of the Earth. Optionally a clock/date circuit and an audible indicator are provided, so that the electronic computing device can automatically know the time and the date, and can sound a call for prayer for the operator at each of the Islamic prayer times on the current day.

1 Claim, 9 Drawing Figures

ISLAMIC PRAYER CALCULATOR/CLOCK DEVICE

BACKGROUND OF THE INVENTION

The present invention relates to an Islamic prayer calculator/clock device, and more particularly relates to a calculator/clock device which can calculate the appropriate times for Islamic prayer on an arbitrary date at an arbitrary point on the surface of the Earth, based upon latitude and longitude information relative to said point.

In the Islamic religion it is required to perform acts of prayer five times per day, and it is very important from a religious point of view that these acts of prayer should be performed at or soon after certain predetermined times of day. These correct and appropriate times of day are specified in Holy Writ, or rather methods for calculating them are so specified; and in more recent times elucidations of the precise methods for determining such times have been made by scholars. Various algorithms by which the appropriate prayer times are determined are per se known.

However, the problem has always existed, and has plagued Muslims, that these prayer times, for any particular point on the Earth's surface, are all determined strictly in terms of the position of the Sun in the heavens as seen at that point. For example, one school of scholarship holds that the appropriate time for the starting of the first prayer of the day, or "FAJR", is at the instant that the center of the Sun passes through an imaginary line in the heavens 18° below the eastern horizon line. All the other prayer times are likewise determined in the same way in terms of the position of the Sun in the heavens, as for example the start of "ZOHR" which is considered to be at the instant that the center of the Sun reaches the zenith in the heavens or the highest point above the horizon in that particular day. Now to determine at what times (referred either to Greenwich time or local time) the Sun attains these positions in the heavens, as viewed from a particular point on the Earth's surface, is most difficult without the making of detailed astronomical observations. This has been a matter of concern to religious people in Islam for centuries, because the performance of prayer at the appropriate times is very important for the devout.

A solution which has been practiced in the past is to perform calculations for certain important points on the Earth's surface of the position of the Sun in the heavens, based upon tables and equations of the Earth's rotation and orbital motion around the Sun, and to publish tables of appropriate prayer times. This solution has been appropriate within its limits; however, the shortcomings thereof are: first, that it involves much labor; and, second, that it can only be performed for a certain limited number of important or reference points. For instance, tables are nowadays thus made available of appropriate prayer times only at specific locations in a few major cities. For each country of the world, in fact, tables are available of appropriate prayer times only at certain key points. To a crude approximation, the appropriate prayer times for intermediate points can be obtained by a process of interpolation; but the results obtained are only guesswork, which is from the strict religious point of view quite unacceptable. In principle, even a movement of a few thousand meters on the surface of the Earth makes an appreciable difference to the appropriate times for prayer. Further, the repeated preparation of these tables of prayer times even for a limited number of points continues to cause great labor and uncertainty to the religious community. In the Middle Ages such religious prayer time calculation requirements were the spur to the flowering of Arabic astronomical and mathematical knowledge; but nowadays this motivational advantage is rather obsolete, along with increasing astronomical and scientific sophistication and accuracy in the general scientific world. The problem of calculating these prayer times has been further exacerbated, as the world of Islam has expanded all over the globe.

Algorithms exist nowadays for determining the precise absolute position of the Sun in the heavens at any particular time. Further, corresponding inverse algorithms are currently known for determining at what time on a particular day the Sun will be in a particular absolute heavenly position.

Further, in the past it was not very easy to know the precise location of any arbitrary point on the surface of the Earth. Such determinations could only be made by detailed and difficult astronomical or surveying observations performed at that point. However, recently very accurate maps of various countries prepared by new satellite and radar techniques have become available, indicating with great exactness the latitude and longitude of a great variety of identifiable points. It is not now beyond the ability of any person to precisely known the latitude and longitude of even the most remote and most inaccessible village, and of course this information never changes.

Yet further, in the matter of clocks and calculators relating to Islamic prayer times, it is per se known for an ordinary type of clock to be provided with multiple audible announcing devices or alarms which can be set for indicating the occurrences of the appropriate times for prayer. However, such alarms have in the prior art always been required to be manually set to the proper local prayer times, in accordance with published time tables, and accordingly such art has not contributed in any way to the problem of actually establishing these local prayer times.

SUMMARY OF THE INVENTION

Accordingly, it is the primary object of the present invention to provide a calculator/clock device which can determine quickly and accurately the exact appropriate times for Islamic prayer at any arbitrary point on the Earth's surface on any arbitrary date and can output an indication of these prayer times.

It is a further object of the present invention to provide such a calculator/clock device which can provide a call for prayer at said appropriate Islamic prayer times.

According to the most general aspect of the present invention, these and other objects are accomplished by a prayer calculator/clock device, comprising: (a) a first input means for inputting the latitude and longitude of a spot on the surface of the Earth at which it is required to indicate proper times for Islamic prayer; (b) a second input means for inputting a date on which it is required to indicate proper times for Islamic prayer; (c) a means for electronically computing at what times the position of the sun in the heavens, on said date inputted thereto via said second input means, as seen from said spot on the surface of the Earth defined according to said latitude and longitude information inputted thereto via said first input means, is appropriate for Islamic prayer; and (d) a means for outputting from said electronic computation means said determined appropriate times for Islamic prayer on said date at said spot on the surface of the Earth.

According to such an apparatus, the operator first determines the exact latitude and longitude of the point on the Earth's surface at which he or she desires to determine prayer information, which quite typicaly will be the actual point of location of the device according to the present invention and of its operator. This may be done in any one of various ways, for example by consulting a detailed map or almanac or by inquiry from a geographical bureau of the government such as a weather bureau. Then the operator of the device inputs to it the date for which prayer time information is required, which again quite typically will be the current date. From this information the electronic computing means computes the proper times for Islamic prayer at said point on the surface of the Earth on said date, and outputs these times via said outputting means.

Further, according to a more particular aspect of the present invention, these and other objects are more particularly and concretely accomplished by a prayer calculator/clock device of the type described above, wherein said computing means calculates said appropriate Islamic prayer times in terms of local time at said point on the surface of the earth, and said outputting means likewise outputs said appropriate Islamic prayer times in terms of said local time.

According to such an apparatus, the appropriate Islamic prayer times at said point on the surface of the Earth are output in a useful local format.

Further, according to a more particular aspect of the present invention, these and other objects are more particularly and concretely accomplished by a prayer calculator/clock device of the type described above, further comprising a clock which inputs to said electronic computing means the current time, and an audible indicator, and wherein said electronic computing means controls said audible indicator so as, at said appropriate Islamic prayer times, to provide a call for prayer indication signal via said audible indicator.

According to such an apparatus, when the appropriate local time for Islamic prayer at said point on the surface of the Earth arrives, said call for prayer indication signal is given by the device, so as to alert the faithful to the imminent necessity for performance of prayer.

Further, according to a more particular aspect of the present invention, these and other objects are more particularly and concretely accomplished by a prayer calculator/clock device of the type first described above, wherein at least in one operational mode said date inputting means maintains an ongoing record of the current date and automatically inputs the current date to said electronic computing means.

According to such an apparatus, in at least said one operational mode the current date is automatically fed into said computing means, so that current prayer time information is quickly available without undue manipulation.

Further, according to a more particular aspect of the present invention, these and other objects are more particularly and concretely accomplished by a prayer calculator/clock device of the type described above, wherein said computing means further calculates an angle indicative of the direction towards Mecca from said spot on the surface of the Earth.

According to such an apparatus, this further useful religious information is conveniently made available.

In further detail, according to a more particular aspect of the present invention, these and other objects are more particularly and concretely accomplished by a prayer calculator/clock device of the type first described above, wherein said computing means comprises: a means for determining a standard date and time which specify a relative position between the Earth and the Sun; a means for computing the declination angle at that particular standard day and time; a means for finding the time difference between the nominal position of the Sun relative to the Earth and the actual position of the Sun relative to the Earth; a means for computing the position of the Sun in the sky at the particular spot on the Earth according to the standard day and time, the declination angle, the time difference between the nominal position and the actual position of the Sun, and the longitude and the latitude of the spot; and a means for associating the Islamic prayer times with the computed position of the Sun in the sky.

And in alternative further detail, according to another more particular aspect of the present invention, these and other objects are more particularly and concretely accomplished by a prayer calculator/clock device of the type first described above, wherein said computing means comprises: a means for determining a standard epoch which specifies the relative position between the Sun and the Earth; a means for computing the declination angle at the epoch; a means for finding the time difference between the nominal position and the actual position of the Sun relative to the Earth; a means for computing the angle between a great circle line connecting the spot and Mecca and another great circle line connecting the spot to the North pole and the South pole; a means for computing the position of the Sun in the sky according to the epoch, the declination angle, the time difference between the nominal position and the actual position of the Sun, and the longitude and the latitude of the spot; and a means for associating the Islamic prayer times with the computed position of the Sun in the sky.

BRIEF DESCRIPTION OF THE DRAWINGS

The present invention will now be shown and described with reference to a preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENT

Figure 7:
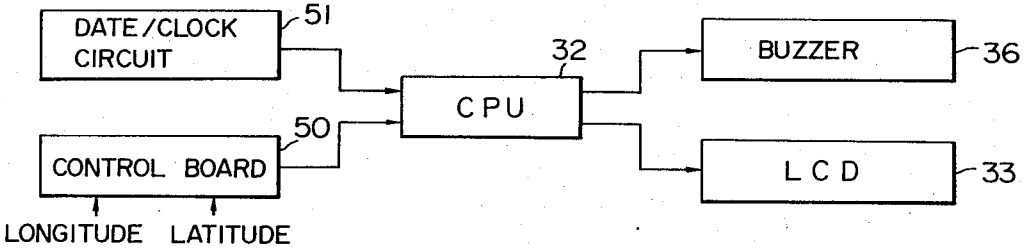
FIG. 7 is a block diagram of the actual construction as a whole of said preferred embodiment of the present invention.
Figure 9:
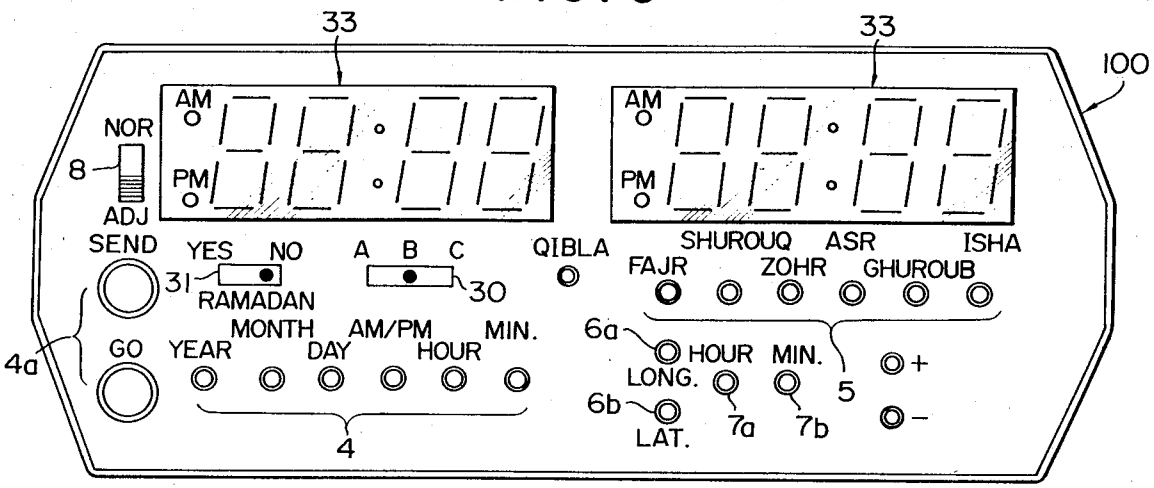
FIG. 9 is a schematic illustration of a control panel of said preferred embodiment.
Figure 8:
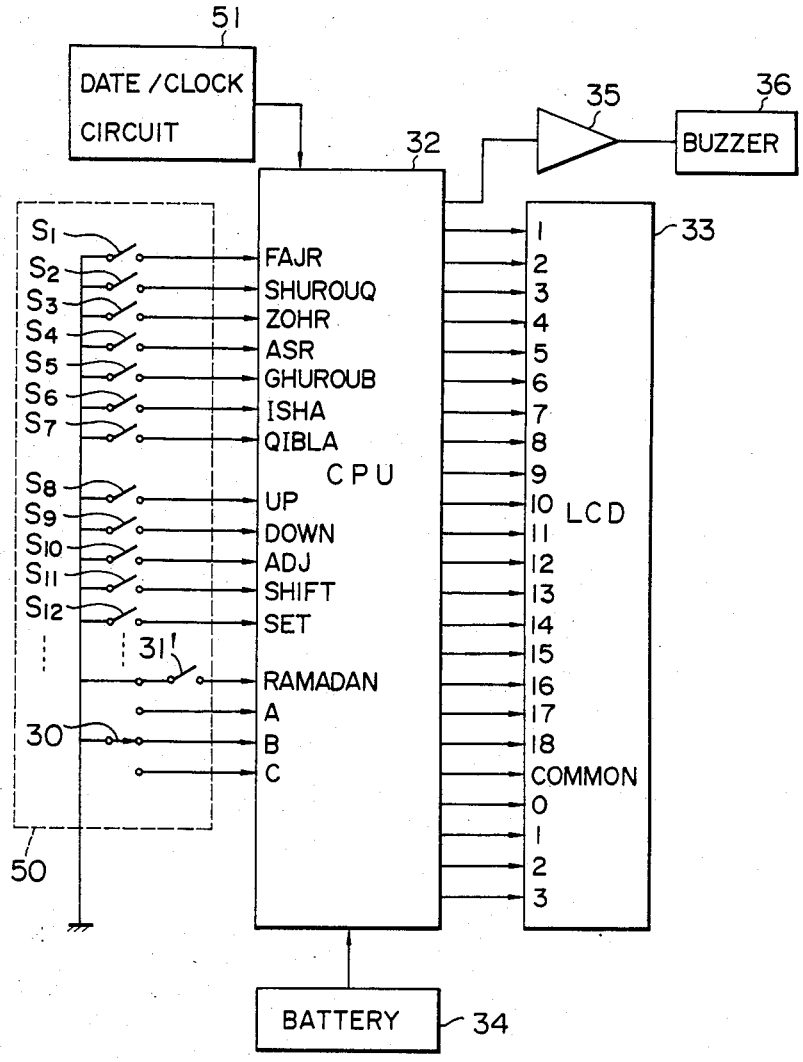
FIG. 8 shows said construction in somewhat greater detail.

The present invention will now be described with reference to the preferred embodiment thereof, and with reference to the appended drawings. In FIG. 7, the reference numeral 32 denotes a CPU of a microcomputer, and 50 is a control board comprising a number of buttons while 33 is a LCD display board. FIG. 9 is a schematic illustration of the control board 50 and the display 33, and FIG. 7 is a block diagram of the construction of the preferred embodiment generally, while FIG. 8 shows the construction of the essential part thereof in more detail. The control board 50 and the display board 33 are connected to the microcomputer via appropriate interfaces of per se well known sorts, not shown, incorporated in said microcomputer. In this preferred embodiment there are also provided a clock/-date circuit 51 and an audio announcing device or buzzer 36, both of which are also of per se well known sorts and are similarly connected to the CPU 32 of the microcomputer.

The details of the programming of the microcomputer will not be expatiated upon herein, because, based upon the functional details of the operation of the microcomputer disclosed herein, they may be supplemented by one of ordinary skill in the microprogramming art. The functioning of the system will now be described, first in terms of the broad general purposes that it fulfils, and later with respect to the mathematical functions which it performs.

First, in its so called calculation mode, a date is input to the CPU 32 of the microcomputer via the control board 50 by manipulating certain appropriate ones of the buttons thereon including the "YEAR" button, the "MONTH" button, and the "DAY" button in a per se obvious and/or well known way. The date may be input either in terms of the Gregorian calendar or in terms of the Islamic calendar, according to the details of the program of the CPU 32 of the microcomputer, or optionally either if a means for indicating which is being employed is provided. Next, the latitude and the longitude of a place on the Earth's surface for which the prayer times are required are inputted to the CPU 32 of the microcomputer, again via the control board 50 by manipulating certain appropriate ones of the buttons thereon including the "PLUS" button, the "MINUS" button, the "LATITUDE" button, the "LONGITUDE" button, the "DEGREE" button, and the "MINUTE" button in a per se obvious and/or well known way.

Then the microcomputer performs its computing action and computes internally the appropriate times for Islamic prayer at that indicated spot on the Earth's surface on that date. In the most general form of the present invention, the CPU 32 of the microcomputer need not be provided with any information relating to the local time utilized at that point on the Earth's surface; and accordingly in such a case these times come to be be calculated in terms of GMT or absolute local time, but in fact as will be shortly explained in the shown preferred embodiment such local time information is in fact available to the CPU 32 of the microcomputer, and therefore the prayer times are calculated in terms of the local time utilized at that point. In any case, the microcomputer then displays the prayer time information on the LCD display board 33. In the shown preferred embodiment, when the "FAJR" button is pressed (FAJR is the first time of the day for Islamic prayer) the time for FAJR prayer is displayed on the LCD display board 33 by the CPU 32 of the microcomputer; when the "ZOHR" button is pressed (ZOHR is the second time of the day for Islamic prayer) the time for ZOHR prayer is displayed on the LCD display board 33 by the CPU 32 of the microcomputer; when the "ASR" button is pressed (ASR is the third time of the day for Islamic prayer) the time for ASR prayer is displayed on the LCD display board 33 by the CPU 32 of the microcomputer; when the "GHUROUB" button is pressed (GHUROUB is the fourth time of the day for Islamic prayer) the time for GHUROUB prayer is displayed on the LCD display board 33 by the CPU 32 of the microcomputer; and when the "ISHA" button is pressed (ISHA is the fifth and last time of the day for Islamic prayer) the time for ISHA prayer is displayed on the LCD display board 33 by the CPU 32 of the microcomputer. Further, in this preferred embodiment, when the "SHUROUQ" button is pressed (SHUROUQ is the time of sunrise, and is not directly a prayer time but is important and useful religious information which it is convenient to the user to have) the local time of sunrise according to the Islamic definition is displayed on the LCD display board 33 by the CPU 32 of the microcomputer.

Further, it should be understood that according to the clock operational mode of the preferred embodiment of the present invention the clock/date circuit 51 is constantly supplying information relating to the current local time and the current date to the CPU 32 of the microcomputer. This time and date may be reset by the operator from time to time on the control board 50: the date in a fashion similar to that outlined above, and the time by manipulating certain appropriate ones of the buttons thereon including the "AM/PM" button, the "HOURS" button, and the "MINUTES" button, in a per se obvious and/or well known way. This time may be set and handled in terms of a locally used form of time that is referenced to Greenwich standard time, in conjunction with the longitude information to be input shortly. For instance, in the case of daylight saving time being utilized or the like, provision should be made in the program of the CPU 32 of the microcomputer for indicating the time difference between the input time and the equivalent GMT time. In the shown preferred embodiment, in fact, this time information is available from the clock/date circuit 51, when once it has been set therein. Now, before the clock operational mode of the system can be functional, information regarding latitude and longitude must also be input by the operator to the CPU 32 of the microcomputer in a fashion analogous to that outlined above with respect to the computational operational mode, and must be set into said CPU 32 of the microcomputer via the use of some ones of the buttons on the display board 50. Thenceforward, from time to time (preferably just after midnight on the morning of each new day) the CPU 32 of the microcomputer by itself without prompting performs a calculation for the new current day analogous to that described above, in order to determine the times for Islamic prayer (and optionally the time of sunrise) on that day, and sets internal functions such as the values in internal registers (not shown in any form in the drawings) to those times. Thereafter, when the local time during the current day becomes equal to these times in turn, the CPU 32 of the microcomputer alerts the operator to the desirability of prayer (or optionally to sunrise) by flashing the display and/or by operating the audio announcing device or buzzer 36.

Thus, it is seen that according to the present invention there is provided a calculator/clock device which can determine quickly and accurately the exact appropriate times for Islamic prayer at any arbitrary point on the Earth's surface on any arbitrary date and can output an indication of these prayer times, and which further can provide an audible type output at said appropriate Islamic prayer times.

As a further helpful and desirable feature of the present invention, it is possible to provide the CPU 32 of the microcomputer with a further program which calculates at the point whose latitude and longitude have been inputted into the CPU 32 of the microcomputer as described above (i.e. typically at the point of use of the device) the angle between true north and the geodesic or great circle line to Mecca from said point; and this is done in the preferred embodiment. This angle is calculated according to algorithms which will be explained hereinafter. Such an indication of the proper direction to Mecca can be of great help for religious purposes, since accurately determining this also is a problem for the devout at the present. Alternatively some other angle defined between the direction of Mecca and some other reference direction could be calculated.

Now, the functioning of the system will now be described with respect to the mathematical functions which it performs. In this connection, in FIGS. 1 through 4 and in FIG. 6, flow charts will be shown which actually describe the operation of the program in the microcomputer CPU 32; but the blocks of these flow charts will be described as though they were actual elements of the system, for the convenience of description and in order to avoid any detailed discussion of the per se well known internal workings of the CPU 32.

The memory associated with the CPU 32 permanently stores the following information: (1) programs for controlling the action of the CPU 32; (2) constants which represent a mathematical model of the orbital motion of the Sun relative to the Earth on a certain epoch date which may be arbitrarily selected (these constants vary only by small amounts which may be neglected within a time frame of a hundred years or so); (3) mathematical constants for giving the trigonometric values for various angles; (4) other constants which are related to this invention.

EPOCH DATE

The basic constants and parameters which are required for a mathematical model for representing the motion of the Sun relative to the Earth which are directly related to the object of this invention are the following four: (a) e, the eccentricity of the orbit of the Earth moving around the Sun; (b) $\epsilon$, the declination of the ecliptic; (c) M, the mean anomaly (the average angular deviation from perihelion of the Earth's orbit); (d) $\tilde{\omega}$, the longitude of the perihelion of the Earth's orbit.

Since these values vary only by small amounts which can be neglected within a time frame of a hundred years or so, it is possible to reduce the errors of these values by selecting an appropriate epoch date and by performing the computation of the motion of the Sun from that epoch date.

In the following description, it is assumed that e and $\epsilon$ are constant. However, M and $\tilde{\omega}$ are values which vary every day. Furthermore, the computations based upon these values are to be performed according to the cumulative number of days from the epoch date. Other coefficients are to be used in the following computation, but these coefficients are directly dependent upon the above described four fundamental coefficients, and are readily computable for any arbitrary epoch date according to well known formulae of astronomy for a person skilled in the art.

In achieving the objects of this invention according to such a plan, the constants which are to be stored in the ROM of the device are as listed in Table 1, which is displayed at the end of this specification and before the claims relating thereto.

CUMULATIVE NUMBER OF DAYS

A date must be indicated by year, month, and day, and the cumulative number of days is computed in an arithmetic unit 2 according to the cumulative number of days d of that particular year which was obtained by a date adder 1 (FIGS. 1 and 2), as per Equation 1, where $d_{acc}$ is the cumulative number of days, Yr is the difference between this year and the year to which the epoch date belongs in years, and the constant 0.25 is for accounting for leap years.

It is to be noted that the cumulative number of days $d_{acc}$ should be an integer. The device according to this invention is thus equipped with an internal calendar to which the user may set up an arbitrary date. This calendar can give a month and a year according to the cumulative number of days.

THE DECLINATION ANGLE OF THE SUN

Figure 1:
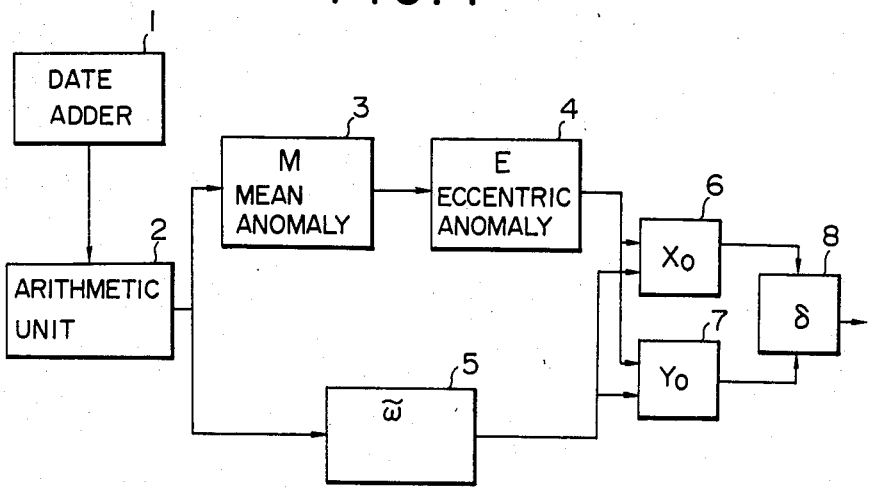
FIGS. 1 through 4 are schematic block diagrams symbolically showing the structure and operation of the preferred embodiment of the device according to the present invention.
Figure 2:
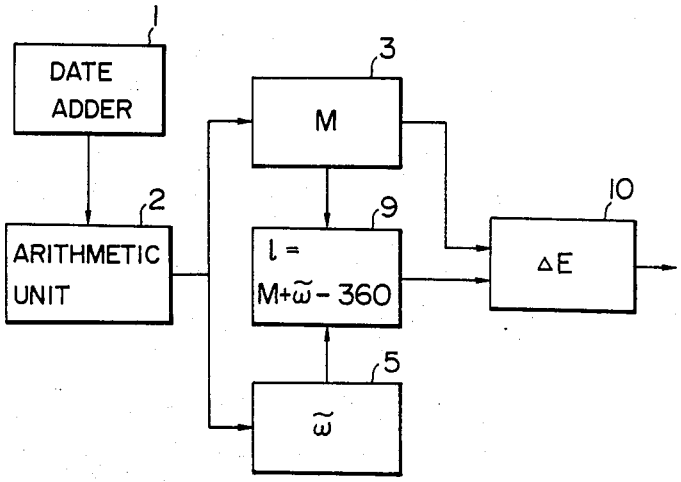

The declination angle $\delta$ of the Sun relative to the equator of the Earth, which varies all the time, can be computed in the arithmetic units 3, 4, 5, by retrieving the relevant constants stored in the ROM of the device and performing an algorithm which includes the manipulation of Equations 2, 3, and 4, according to a program stored in the device (see FIG. 1).

In other words, by manipulating Equations (3) and (4) according to Equations (1) and (2), the true values of E and $\tilde{\omega}$ on a certain specific day which is set up in the device can be found. These results are further used for finding, according to Equations 5 and 6, in the arithmetic units 6, 7, the x and y coordinates of the Earth in the orbital plane of the Earth, when the Sun is assumed to be at the origin.

Next, the declination angle $\delta$ of the Sun may be obtained in the arithmetic unit 9 from Equation 7, based on the data obtained according to equations (5) and (6).

In Equation 7 it is to be noted that the sign of $\delta$ is positive in summer and negative in winter. And it is also to be noted that the units used in these equations are degrees or radians.

Trigonometric functions can basically be converted into various forms, but such conversion of the forms makes up the basic part of this invention in the same way as the selection of the constants in relation therewith, and also the important items of consideration which strongly influence the required computing time and the memory capacity of the device according to this invention.

EQUATION OF TIME

The equation of time here means the difference between the nominal time which is obtained by dividing a day into twenty-four hours and the actual time. This difference is obtained as the difference between the time the Sun passes the meridian at a longitude zero spot like Greenwich and the actual noon. The equation of time depends upon two variables, the mean anomaly, and l, which accounts for the Sun's average longitude along the great celestial sphere around the Earth computed from the vernal equinox, or the point of Aris. Therefore, by performing computation according to Equations 8 and 9 in the arithmetic units 9, 10, the time difference $\Delta E$ may be obtained.

Figure 3:
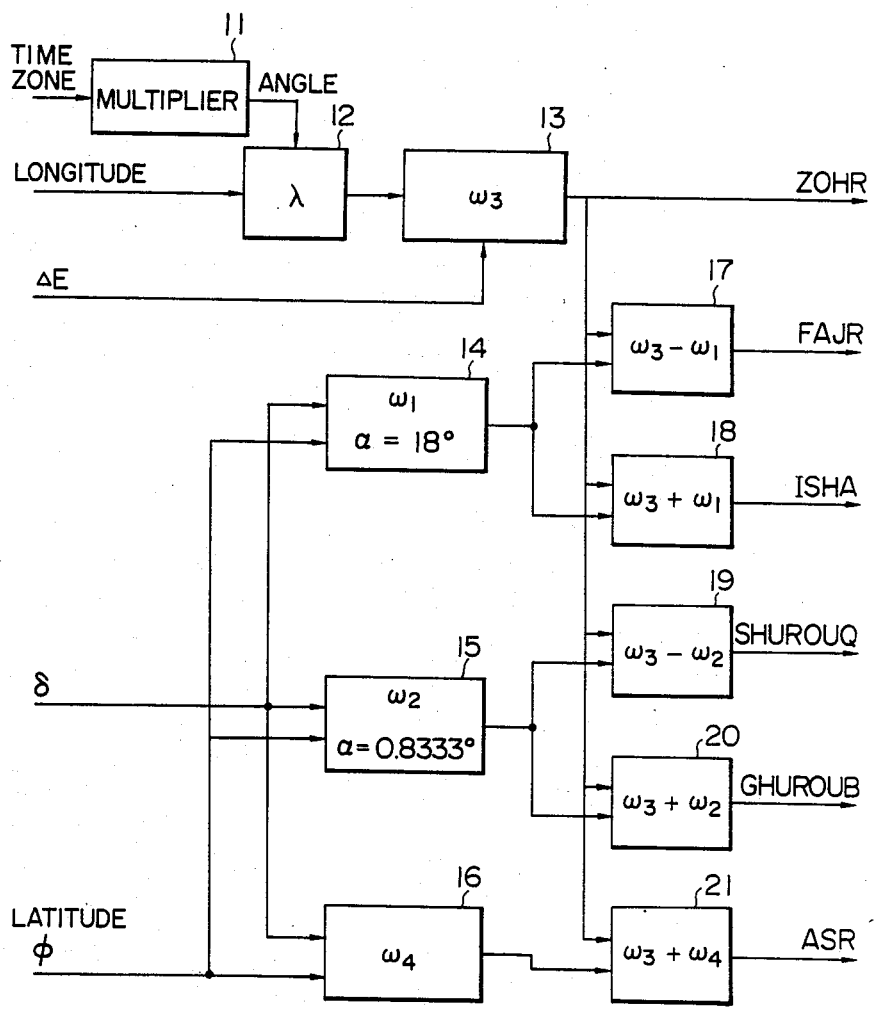

The result of the manipulation of the above mentioned equations is expressed in degrees of arc, so it is converted into minutes and seconds by multiplying 4 to the result of equation (9) in the multiplier 11 (see FIG. 3).

IDENTIFICATION OF LOCATION

An arbitrary spot on the Earth can be identified by its angular displacement from the equator, or the latitude, and its angular displacement relative to the great circle line which passes through the North pole and Greenwich, or the longitude. For instance, the location of Tokyo may be expressed as 35° 39′ north latitude and 139° 45′ east longitude. The device according to this invention is equipped with a means for inputting the longitude and latitude of an arbitrary spot on the Earth, comprising the push buttons *6a*, *6b*, *7a* and *7b* as explained above. This longitude and latitude may be known, as previously mentioned, from almanacs and maps, or by enquiring from a weather bureau or some other public institution.

In finding the path of the Sun in the sky, the time at which the Sun passes the meridian is often used as a reference time. On the equator, at either the spring or the autumn equinox, the sunrise and sunset take place when the Sun has displaced 90° from the meridian. Two sets of information are necessary to find the location of the Sun at a particular spot on a particular day with the device. The first is how far the spot is angularly displaced from the equator, and the second is how far the Sun is angularly displaced from the equator. Therefore, the angular position of the Sun may be computed from Equation 10, in which $\delta$ is the angle of declination of the Sun, $\phi$ is the latitude of the spot, and $\alpha$ is the angle of the central point of the Sun relative to the horizon.

At sunrise or sunset, $\alpha$ is a small value smaller than 1°, which is based upon the angle corresponding to the radius of the Sun's disk and the angular difference between the actual position of the Sun and the apparent position of the Sun due to the diffraction of light. On the other hand, at the twilight time, $\alpha$ is 6° in the case of civil twilight, 12° in the case of nautical twilight, and 18° for astronomical twilight.

To compute the time of the meridian pass with the device, it suffices to note that the Sun makes a 360° orbital motion in twenty-four hours. In other words, it takes four minutes for the Sun to make a 1° motion. And the Earth is divided into twenty-four time zones, and each time zone corresponds to a 15° motion of the Sun. The standard time is based on the Greenwich time and, to know the time of meridian pass at an arbitrary spot on the Earth, it is necessary to identify the time zone of the spot and to input it into the device. Then the device converts such a time into an angle and deducts the longitude of the spot which was inputted into the device therefrom. What is obtained as a result is the longitude of the spot at which the local time is set minus the accurate longitude of the spot.

For instance, Tokyo is located at 139° 45′ east longitude, and, when the time of meridian pass at Akashi, which is located at 135° east longitude ($9\times15°$) is set as a reference, the time at Tokyo is nine hours earlier than the time at Greenwich. The difference between these two longitudes, or minus 4° 45′, means that Tokyo is located 4°45′ east of Akashi. This angle difference may be used in the following equations in the arithmetic unit 12 as $\lambda$.

PRAYER TIMES

Muslims perform prayers five times a day. The first prayer, FAJR, is to be performed at dawn, which is defined as the astronomical twilight at which the center of the Sun is 18° below the eastern horizon. This generally applies, but in some regions the angle is 19.5°, and in other areas the dawn is defined as eighty-five minutes before sunrise.

The second prayer, ZOHR, is to be performed when the Sun passes the meridian at that spot.

The third prayer, ASR, is to be performed in the afternoon when the shadow of an upright object is equal to its height plus the length of its shadow at meridian pass.

The fourth prayer, GHUROUB, is to be performed at the time when the Sun totally disappears behind the western horizon.

The fifth prayer, ISHA, is to be performed at the time of astronomical twilight, and this, as will be described later, may also be the time at which the angle between the Sun and the horizon is 17.5°, or 1.5 hours (however, two hours for the month of Ramadan) after the sunset, as in the case of the morning twilight.

In most Muslim countries, the morning and the evening twilight, or FAJR and ISHA, are defined as the times when the center of the Sun is 18° below the horizon, or at the time of astronomical twilight. However, in other countries there are some differences in the definitions of FAJR and ISHA as described above.

First, one can select the above mentioned general definition (definition B). Second, one can select the definition (definition C) according to which the morning twilight or FAJR is the time when the Sun is 19.5° below the horizon, while the evening twilight or ISHA is the time at which the Sun is 17.5° below the horizon (this definition C is adopted by Muslim countries along the mediterranean and in North Africa). Third, one can select the definition (definition A) according to which the morning twilight or FAJR is eighty-five minutes before sunrise, while the evening twilight or ISHA is ninety minutes after the sunset. However, during the month of Ramadan ISHA is defined as 120 minutes after the sunset. In addition to these five prayers, it is useful to know the time of sunrise, or SHUROUQ. Sunrise means the instant at which the upper tip of the Sun appears on the eastern horizon.

According to the device of this invention, as shown in FIG. 3, first ZOHR is given at the arithmetic unit 13 according to Equation 11. Next, w1 is obtained at the arithmetic unit 14 according to Equation 12 given below, w2 is obtained at an arithmetic unit 15 according to Equation 13, and w4 is obtained at an arithmetic unit 16 according to Equation 15. Here, the values of the constants used in Equations 12 and 13 are summarized in Table 2 at the end of this specification.

Further, FAJR is obtained from the difference between w3 and w1 at an arithmetic unit 17, ISHA is obtained from the sum of w3 and w1 at an arithmetic unit 18, SHUROUQ is obtained from the ratio between w3 and w2 at an arithmetic unit 19, GHUROUB is obtained from the sum of w3 and w2 at an arithmetic unit 20, and ASR is obtained from the sum of w3 and w4 at an arithmetic unit 21.

The block diagram of FIG. 3, schematically shows the above description.

The output thus obtained from the device is immediately converted into hours, minutes, and seconds, so that it may be displayed in a form which is readily understandable to the user.

Figure 4:
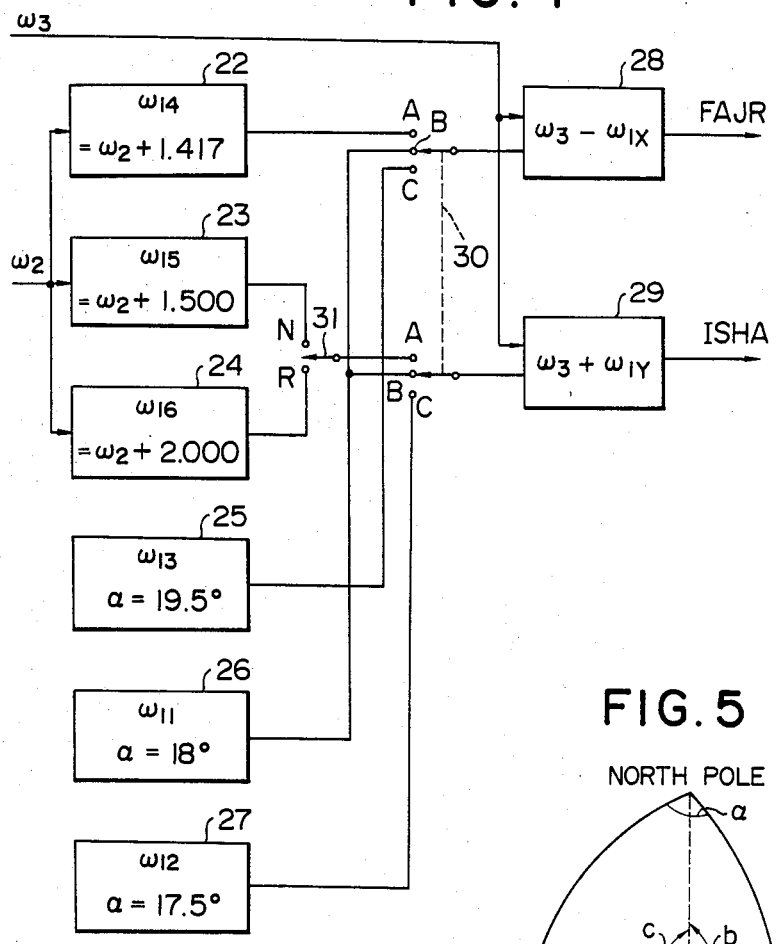

The device of this invention is equipped with a switch 30 (see FIG. 9) for selecting any one of these three different definitions. As shown in FIG. 4, it suffices to select the following values for w1 in addition to w11 so that any of the three definitions may be selected. As far as the third definition is concerned, the same definition is used on any day of the year and any spot on the Earth. Table 2 is stored in the memory of the device and represents various constants which are used for computing the Islamic prayer times. Table 2, again, is displayed at the end of this specification and before the claims relating thereto.

The device of this invention is also provided with a switch 31 (see FIG. 9) for selecting the exception of the month of Ramadan. The block diagram in FIG. 4 shows this switch 31, and likewise shows the switch 30 for carrying out the various selections concerning FAJR and ISHA. In other words, by switching the inputs to the arithmetic units 28, 29 corresponding to the arithmetic units 17, 18 in FIG. 3 to the outputs of arithmetic units 22 to 27, with the switch 30 and the switch 31, the abovementioned three definitions, and Ramadan, may be arbitrarily selected between.

w3 gives the time of meridian pass, and w3-w11, w3-w13, and w3-w14 give FAJR or the times of sunset according to the different definitions.

THE DIRECTION TO MECCA

The Earth is spherical, and it is possible to indicate the direction to a remote place only by accurately determining the angle between two great circle lines according to spherical trigonometry. The two great circles which are required for finding the direction to Mecca from a particular spot defined as follows:

(1) the circle defined by the plane which passes through the spot, the North pole, the South pole, and the center of the Earth. This may be indicated by the use of a normal compass.

(2) the circle indicated by the plane which passes through the spot, Mecca, and the center of the Earth.

When using the device according to this invention, the longitude and the latitude of the spot are inputted by the user, and the longitude and latitude of Mecca are stored in a permanent memory of the device.

Therefore, the device according to this invention can compute the angle between these two great circles according to the method which is well known to a person skilled in the art, by making use of so called cosine formulae. The angle between the two great circles thus computed is stored in a memory of the device in degrees and minutes along with the additional information that it is to the east or the west with respect to the direction to north. This output value may be displayed by pushing a button equipped to the device.

The device according to this invention is also optionally equipped with a compass with $\pm/-179°$ gradations around the direction to Mecca. By turning the outer body of the compass so as to cause its needle to coincide with the gradation which has the same reading as the angle between the two great circles displayed on the device, one can know the direction to Mecca from the direction of the center or zero point of the gradations.

Figure 5:
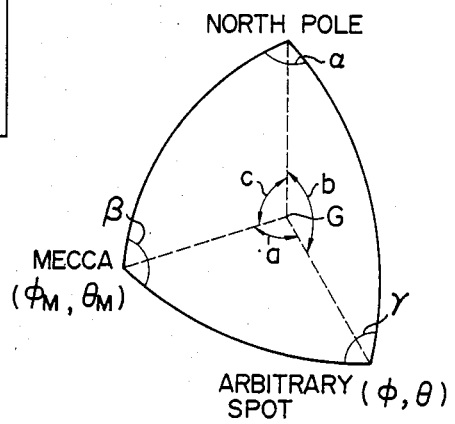
FIG. 5 is a geometrical illustration for the purpose of aiding the explanation of the process of calculation of the direction towards Mecca, performed during the operation of said preferred embodiment.

FIG. 5 is a diagram showing the principle of knowing the direction to Mecca. Suppose a spherical triangle which is defined by the arcs of great circles connecting the North pole, Mecca (longitude $\theta_M$, latitude $\phi_M$), and an arbitrary spot (longitude $\theta$, lititude $\phi$).

Assume as seen from the center of the Earth, the angle between Mecca and the arbitrary spot is a, the angle between the North pole and the arbitrary spot is b, the angle between the North pole and Mecca is c, and the angles of the corners at the North pole, Mecca, and the arbitrary spot and the spherical triangle are $\alpha$, $\beta$, and $\gamma$. By applying Napier's formulae concerning a spherical triangle, one obtains Equations 20 and 21.

Since $\alpha=\theta-\theta_M$, $b=\phi$, and $c=\phi_M$, in other words the angle of Mecca relative to the North pole as seen from the arbitrary spot, may be given from Equation 22.

Figure 6:
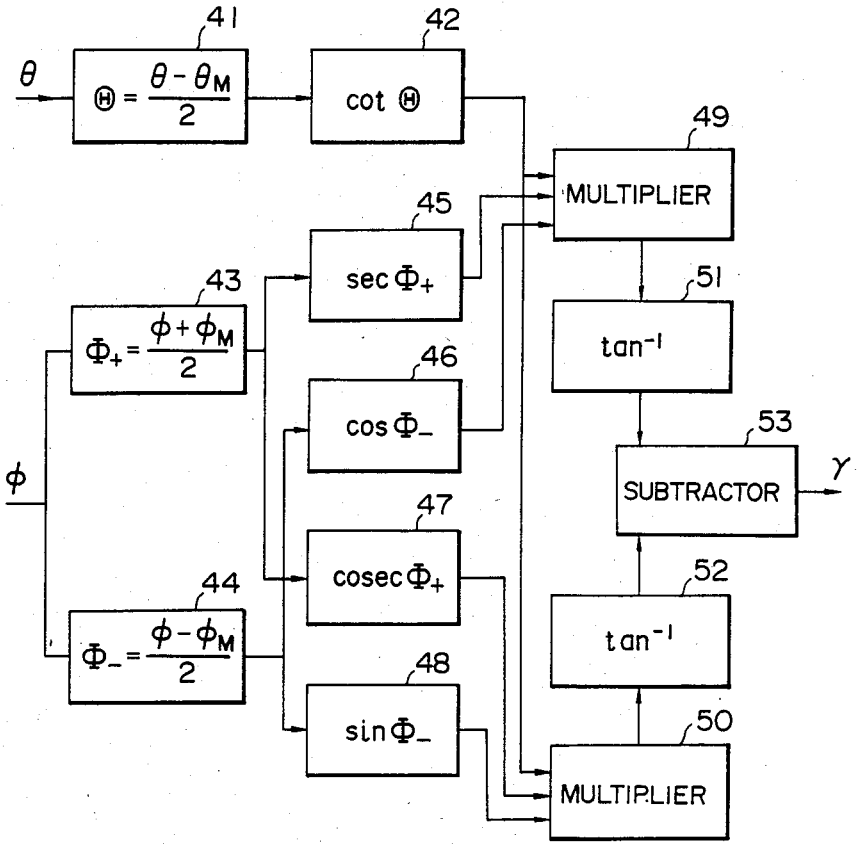
FIG. 6 is a schematic block diagram of the structure of the part of said preferred embodiment of the present invention which performs said process of calculation of the direction towards Mecca.

In the device according to this invention, the above described computation is carried out with the symbolic structure shown in FIG. 6. In other words, the inputted longitude $\theta$ and latitude $\phi$ are converted into appropriate trigonometric functions by arithmetic units 41 to 48, and after being multiplied together by the multipliers 49, 50 each term of the right hand side of equation 20 is obtained in arithmetic units 51, 52. And by finding the difference between them at a subtractor 53, the angle of Mecca relative to the North pole as seen from the arbitrary spot can be obtained.

PRAYER TIME INDICATING DEVICE

The device according to this invention can be used as a clock in time of normal use. It is also possible to accurately display the times for performing each prayer on the day which is displayed on the clock by pushing the push botton corresponding to the prayer time. And by setting the alarm device, it is also possible to sound an alarm when the time for performing each prayer comes.

FIG. 6 shows conceptual connections in the case of constructing the device of this invention with an integrated circuit. In other words, switches S1 to S12 etc., 31, and 30 on the board 50, and the clock/date circuit 51, are connected to the CPU 32 which makes up the central part of the device, and the CPU 32 receives power from a power source 34 on the one hand and supplies its output to the LCD 33 as well as to the buzzer 36 by way of an amplifier 35.

Switches S8 to S12, etc., correspond to switches shown in FIG. 9 and described above for controlling the electronic clock incorporated in the CPU. And by pushing any one of the switches S1 to S6 it is possible to display the time corresponding to either one of FAJR, SHUROUQ, ZOHR, ASR, GHUROUB, and ISHA on the LCD 33. By pushing the switch S7 (denoted as the QIBLA switch), the direction which determines the direction to Mecca is displayed on the LCD 33.

The switch 30 is for selecting either one of the three definitions concerning FAJR and ISHA as described previously, while the switch 31 is for setting up the condition which applies only during the month of Ramadan. And according to the device of this invention, when the time displayed on the LCD 33 coincides with the time for prayer as determined by the longitude and latitude inputted into the CPU 32, the buzzer 36 is sounded.

Although the present invention has been shown and described with reference to a preferred embodiment thereof, and in terms of the illustrative drawings, it should not be considered as limited thereby. Various possible modifications, omissions, and alterations could be conceived of by one skilled in the art to the form and the content of this preferred embodiment, without departing from the scope of the present invention. Therefore it is desired that the scope of the present invention, and of the protection sought to be granted by Letters Patent, should be defined not by any of the perhaps purely fortuitous details of the shown preferred embodiment, or of the drawings, but solely by the scope of the appended claims, which follow, after the Equations and the Tables.

EQUATIONS 1-9

$$d_{acc} = d + n_1 Yr - 0.25 \quad (1)$$

$$M = \text{Mean Anomaly} = n_2 + n_3 d_{acc} \quad (2)$$

$$E = \text{Eccentric Anomaly} = M + n_4 \sin M + n_5 \sin 2M \quad (3)$$

$$\tilde{\omega} = n_6 + n_7 d_{acc} \quad (4)$$

$$X_0 = (\cos E - n_4)\cos\tilde{\omega} - n_8 \sin\tilde{\omega}\, \sin E \quad (5)$$

$$Y_0 = n_9[(\cos E - n_4)\sin\tilde{\omega} - n_8 \sin E \cos\tilde{\omega}] \quad (6)$$

$$\delta = \tan^{-1}[n_{10}\cos\{\tan^{-1}(X_0/Y_0)\}] \quad (7)$$

$$l = M + \tilde{\omega} - 360° \quad (8)$$

$$\Delta E = (\text{Time Difference}) = [n_{11}\sin 2l - n_{12}\sin M + n_{13}\sin M \cos 2l - n_{14}\sin 4l + n_{15}\sin 2M] \quad (9)$$

EQUATIONS 10-19

$$w = \cos^{-1}[-(\sin\alpha + \sin\phi\sin\delta)/\cos\phi\cos\delta] \quad (10)$$

$$\text{Time of Median Pass} = 12\text{ hr} + 4(\lambda - \Delta E)\text{min} = w_3 \quad (11)$$

$$w_1 = w_{11} = \cos^{-1}\left(-\frac{K_1 + R}{T}\right) \quad (12)$$

$$w_2 = \cos^{-1}\left(-\frac{K_4 + R}{T}\right) \quad (13)$$

$$w_4 = \cos^{-1}\left(\frac{\sin\alpha + R}{T}\right) \text{ where} \quad (14)$$

$$\alpha = \tan^{-1}\left\{\frac{1}{1 + \tan(\phi - \delta)}\right\}$$

$$w_{12} = \cos^{-1}\left(-\frac{K_2 + R}{T}\right) \quad (15)$$

-continued $$w_{13} = \cos^{-1}\left(-\frac{K_3 + R}{T}\right) \quad (16)$$

$$w_{14} = w_2 + K_5 \quad (17)$$

$$w_{15} = w_2 + K_6 \quad (18)$$

$$w_{16} = w_2 + K_7 \quad (19)$$

EQUATIONS 20-22

$$\tan\frac{\beta + \alpha}{2} = \cot\frac{\alpha}{2}\,\frac{\cos\frac{(b - c)}{2}}{\cos\frac{(b + c)}{2}} \quad (20)$$

$$\tan\frac{\beta - \gamma}{2} = \cot\frac{\alpha}{2}\,\frac{\sin\frac{(b - c)}{2}}{\cos\frac{(b + c)}{2}} \text{ where} \quad (21)$$

$$\alpha = \theta - \theta_M \quad b = \phi \quad c = \phi_M$$

$$\gamma = \tan^{-1}\left\{\cot\frac{\theta - \theta_M}{2}\,\frac{\cos\frac{\phi - \phi_M}{2}}{\cos\frac{\phi + \phi_M}{2}}\right\} - \tan^{-1}\left\{\cot\frac{\theta - \theta_M}{2}\,\frac{\sin\frac{\phi - \phi_M}{2}}{\sin\frac{\phi + \phi_M}{2}}\right\} \quad (22)$$

TABLE 1

| Constant | Value |
|---|---|
| n1 | 365.25 |
| n2 | 357.70783 |
| n3 | 0.9856 |
| n4 | 0.0167128 |
| n5 | $1.39669 \times 10^{-4}$ |
| n6 | 102.59617 |
| n7 | $470.6845 \times 10^{-7}$ |
| n8 | 0.99986 |
| n9 | 0.91750 |
| n10 | 0.43358 |
| n11 | 0.04304 |
| n12 | 0.033456 |
| n13 | 0.0028772 |
| n14 | 0.0009262 |
| n15 | 0.0003491 |

TABLE 2

| | | |
|---|---|---|
| K1 | 0.3007 | Signed value of the angle of the Earth's rotation between the morning and evening twilights according to definition C; |
| K2 | 0.30902 | Signed value of the angle of the Earth's rotation between the time of morning twilight and sunrise and between the sunset and the evening twilight according to definition B; |
| K3 | 0.33381 | Signed value of the angle of the Earth's rotation between the time of morning twilight and sunrise according to definition C; |
| K4 | 0.01454 | Signed value of the angle between the upper or lower end of the Sun's disk and its center, i.e. of its angular radius; |
| K5 | 1.41667 | The time between the morning twilight and sunrise according to definition A (hours); |
| K6 | 1.50 | The time between the sunset and the evening twilight according to definition A (hours); |
| K7 | 2.00 | The time between the sunset and the evening twilight during the month of Ramadan according to definition A (hours); |
| K8 | 39.81667 | Latitude of Mecca; |
| K9 | 21.45 | Longitude of Mecca; |

TABLE 2-continued

| | |
|---|---|
| K10 158.55 | 180°-K9. |

What is claimed is:

1. A calculator/clock device, comprising:

(a) a first input means for inputting a date;

(b) a first calculation means for electronically computing, according to a substantially continuous and substantially smooth function of time based on a mathematical model:

(i) first data representing the difference of time by which the mean Sun differs in position from the true Sun; and (ii) second data representing the angular distance of the solar disc North or South of the celestial equator, at a certain reference time or day on said date inputted via said first input means;

(c) a second input means for inputting the longitude and latitude of a location on the surface of the Earth;

(d) a second calculation means for electronically computing, using said first data, third data repreentative of the time of meridian transit of the Sun, on said date, at said longitude as inputted via said second input means;

(e) a third calculation means for electronically computing, using said second data, said third data, said latitude as inputted via said second input means, the times at which the angular position of the Sun relative to the meridian on said date as seen at said location, appropriate for Islamic prayer;

(f) a means for outputting from said third computation means said appropriate times for Islamic prayer.

* * * * *